United States Patent [19]

Nakamura et al.

[11] 4,050,960

[45] Sept. 27, 1977

[54] METHOD FOR DECREASING THE AMOUNT OF CARBON AND NITROGEN CONTAINED IN THE FERROCHROME ALLOY

[75] Inventors: Yasushi Nakamura; Michihisa Itou, both of Tokyo; Mitsuo Uchimura, Yokohama, all of Japan

[73] Assignee: Nippon Steel Corporation, Tokyo, Japan

[21] Appl. No.: 693,621

[22] Filed: June 7, 1976

Related U.S. Application Data

[63] Continuation of Ser. No. 531,218, Dec. 10, 1974, abandoned.

[30] Foreign Application Priority Data

Dec. 11, 1973 Japan ..... 48-137372

[51] Int. Cl.[2] ..... C21D 1/74; C22F 1/02

[52] U.S. Cl. ..... 148/16; 75/.5 C; 75/28; 75/84; 75/130.5; 148/20.3

[58] Field of Search ..... 75/.5 BA, .5 BB, .5 C, 75/28, 130.5, 84; 148/16, 20.3

[56] References Cited

U.S. PATENT DOCUMENTS

| | | | |
|---|---|---|---|
| 2,541,153 | 2/1951 | Chadwick | 75/28 |
| 3,595,709 | 7/1971 | Sordillo et al. | 148/16 |

*Primary Examiner*—R. Dean

*Attorney, Agent, or Firm*—Watson, Leavenworth, Kelton & Taggart

[57] ABSTRACT

A low-carbon ferrochrome alloy containing a decreased amount of nitrogen can be made by this method. This method is conducted in a hydrogen stream and does not necessitate use of vacuum technique. A product of high purity can be obtained relatively simply and economically.

4 Claims, No Drawings

METHOD FOR DECREASING THE AMOUNT OF CARBON AND NITROGEN CONTAINED IN THE FERROCHROME ALLOY

This is a continuation of application Ser. No. 531,218, filed Dec. 10, 1974, abandoned.

DETAILED DESCRIPTION OF THE INVENTION

This invention relates to a method for decreasing the amount of carbon and nitrogen contained in a ferrochrome alloy. More particularly, it relates to such method in which the ferrochrome alloy is refined by treatment in a hydrogen stream.

As is well known, it is possible to decrease the content of carbon and nitrogen in stainless steel to an extreme extent to thereby enhance its anticorrosion property, the toughness, etc. It is, however, difficult to lower to a satifactory extent the content of carbon and nitrogen in the ferrochrome which is the material for the steel. For example, in a method of decreasing the carbon and nitrogen content in pelletized low-carbon ferrochrome alloy (Japanese Patent Laid Open No. 8352/72), it is necessary for refining the low-carbon ferrochrome to heat the material under vacuum at a high temperature of 1300° C or more. Moreover, a treatment as long as 30 to 40 hours is required in order to conduct effective decarburization and denitrification treatments. It inevitably requires an apparatus on a large scale, and the long-time heating under vacuum at 1300° C or more of the high-chrome alloy such as low-carbon ferrochrome will give rise to the decrease by evaporation of the chrome content, which results in lowering the yield of the chrome.

There is also a problem in this method that, despite of the treatment amounting to as long as 40 hours, the rate of removing the carbon and the nitrogen is low, giving an adverse productivity.

It is therefore an object of the invention to overcome the disadvantages encountered in the prior art.

It is another object of the invention to provide a method of decreasing the amount of carbon and nitrogen in pulverized ferrochrome alloy, particularly in pulverized low-carbon ferrochrome alloy, in a relatively simple and economical manner.

According to this invention, there is provided a method for decreasing the content of carbon and nitrogen in pulverized ferrochrome alloy which comprises forming an oxide film on the surface of the pulverized ferrochrome alloy and thereafter heating the same in a hydrogen stream at a temperature between 1000° C and 1300° C for about 3 to 20 hours.

This invention is further described in detail as follows.

In the practice of this invention, a low-carbon ferrochrome alloy having a carbon content of 0.1% or less should preferably be used as the material. It is then pulverized mechanically to the particle size of 2mm or less. The resulting particles of the pulverized low-carbon ferrochrome alloy are thereafter treated in a oxidizing atmosphere to generate a thin oxide film of 1 $\mu$ or less on the surface of the particles. Alternatively, a molten bath of low-carbon ferrochrome alloy having a carbon content of 0.1% or less is pulverized to the particle size of 1mm to 0.5mm by means of an atomizing process using a jet of such inert gas as helium, argon, etc. or a jet of water. The atomizing condition is such that, in order to generate a thin oxide film of 2 $\mu$ or less, preferably of 1 to 0.5 $\mu$, on the surface of the particles of the pulverized low-carbon ferrochrome, the oxygen in the atmosphere is kept at 5% or less, preferably 1% or less, and the oxygen dissolved in the water to be used for cooling and atomizing is kept at 1.5 ml or less, preferably 0.3 ml or less, per 1 l of the water at 20° C. Thereafter, the particles of the low-carbon ferrochrome with the surface under oxidized condition are heated at 1000 to 1300° C in a hydrogen stream of at least 3 l/min. The suitable time for treatment inside the furnace should be between about 3 and about 20 hours, preferably between 10 and 20 hours. The hydrogen used is one which contains as little nitrogen as possible. It is allowed to contain up to about 5% steam, preferably up to 1% steam, and most preferably up to 0.1% steam.

By means of the treatment set forth above, the carbon in the particles of the low-carbon ferrochrome is caused to react with the oxide on the surface of the particles and thereby removed, while the nitrogen is removed by way of the hydrogen stream to the amount of nitrogen which keeps the equilibrium with $P_{N_2}$ of the atmosphere. As a result, a ferrochrome alloy of extremely high purity having not more than 0.005% of carbon not more than 0.01% of nitrogen and not more than 0.1% of oxygen can be manufactured in a relatively simple and economical way.

As mentioned hereinabove, in the operation of this invention, the vacuum technique which is complicated from the technical and operative viewpoint is not required at all. The way of operation of this invention is easy without any loss of chromium due to evaporation, whereby the ferrochrome alloy of high purity having not more than 0.005% of carbon, not more than 0.015% of nitrogen and not more than 0.1% of oxygen can be produced economically with good productivity. The ferrochrome alloy produced according to this invention can be utilized not only for the manufacture of alloy steel of high purity but also for the manufacture of a sintered alloy or other powder metallurgy technique.

Preferable embodiments of this invention are shown below.

EXAMPLE 1

A commercially available low-carbon ferrochrome alloy (63% Cr, 34% Fe) which has been pulverized mechanically to the particle size of 2 to 1 mm was heated in a mixed stream of Ar—$H_2O$ at 1000° C for 2 hours. 500 g of the resulting pulverized ferrochrome alloy having an oxide film generated on the surface of the particles was heated in a pure hydrogen stream of 5 l/min containing not more than 0.01% steam, at 1100° C for varied hours up to 20 hours.

Analysis of the alloy before and after the treatment in the hydrogen furnace is shown in Table 1.

Table 1

| | Beginning | After 5 hrs. | After 10 hrs. | After 20 hrs. |
|---|---|---|---|---|
| C % | 0.030 | 0.005 | 0.002 | 0.002 |
| N % | 0.047 | 0.014 | 0.012 | 0.012 |
| O % | 0.31 | 0.22 | 0.093 | 0.063 |

EXAMPLE 2

25 kg of a commercially available low-carbon ferrochrome alloy (63% Cr, 34% Fe) was melted by low frequency wave to give a molten bath. The bath was then pulverized by means of the atomizing process using a jet of argon gas under the conditions that the concentration of the oxygen in the atmosphere was 1.0% and the amount of the molten oxygen in the cooling water was 0.3 ml per 1 l of the water at 20° C. Pulverized ferrochrome alloy was thus obtained, among which 1 kg of the pulverized ferrochrome alloy having the particle size of 0.7 to 0.3 mm was heated in a hydrogen stream of 10 l/min at 1200° C for varied hours up to 20 hours.

Analysis of the alloy before and after the treatment in the hydrogen furnace is shown in Table 2.

Table 2

| | Beginning | After 5 hrs. | After 10 hrs. | After 20 hrs. |
|---|---|---|---|---|
| % C | 0.032 | 0.003 | 0.002 | 0.002 |
| % N | 0.072 | 0.019 | 0.013 | 0.0085 |
| % O | 0.43 | 0.31 | 0.13 | 0.073 |

EXAMPLE 3

A molten bath of a commercially available low-carbon ferrochrome alloy was pulverized by means of the atomizing process using a jet of water under the conditions that the concentration of the oxygen in the atmosphere was 1.0% and the amount of the molten oxygen in the water used for atomizing and cooling was 0.3 ml per 1 l of the water at 20° C. Pulverized ferrochrome alloy was thus obtained, of which 10 kg of the pulverized ferrochrome alloy having the particle size of 1 mm to 0.05 mm was heated in the hydrogen stream of 20 l/min at 1100° C for 17 hours.

Analysis of the alloy before and after the treatment in the hydrogen furnace is shown in Table 3.

Table 3

| Particle size | Before treatment | | | After treatment | | |
|---|---|---|---|---|---|---|
| (mm) | % C | % N | % O | % C | % N | % O |
| 1 ~ 0.7 | 0.037 | 0.074 | 0.44 | 0.002 | 0.011 | 0.4 |
| 0.7 ~ 0.3 | 0.039 | 0.075 | 0.44 | 0.002 | 0.011 | 0.083 |
| 0.3 ~ 0.1 | 0.038 | 0.074 | 0.46 | 0.002 | 0.011 | 0.093 |
| 0.1 ~ 0.05 | 0.037 | 0.073 | 0.48 | 0.002 | 0.011 | 0.091 |

We claim:

1. A method for decreasing the carbon and nitrogen content of pulverized ferrochrome alloy which comprises pulverizing a molten bath of the ferrochrome alloy having a carbon content of 0.1% or less in an atomizing operation by the use of a jet of a cooling water to produce ferrochrome alloy particles of a size of 1 mm to 0.05 mm and further under such condition as to generate an oxide film of 1 $\mu$ or less on the surface of said particles, said water containing oxygen dissolved therein of 1.5 ml or less per 1 l of the water at 20° C, the atmosphere in which the atomizing operation is effected being maintained at 5% or less oxygen, and thereafter heating the particles in a hydrogen stream at a temperature between 1000° C and 1300° C for about 3 to 20 hours to cause carbon in the alloy to react with the oxide film on the surface of said particles whereby the carbon is removed from said particles, nitrogen being removed by said hydrogen stream.

2. The method according to claim 1 in which said hydrogen contains up to about 5% steam.

3. The method according to claim 1 in which the ferrochrome alloy is treated until the same does not contain more than 0.005% carbon, not more than 0.015% nitrogen and not more than 0.1% oxygen.

4. A method for decreasing the carbon and nitrogen content of pulverized ferrochrome alloy which comprises pulverizing a molten bath of the ferrochrome alloy having a carbon content of 0.1% or less in an atomizing operation by the use of a jet of an inert gas to produce ferrochrome alloy particles of a size of 1 mm to 0.05 mm and further under such conditions as to generate an oxide film of 1 $\mu$ or less on the surface of said particles, the atmosphere in which the atomizing operation is effected being maintained at 5% or less oxygen, and thereafter heating the particles in a hydrogen stream at a temperature between 1000° C and 1300° C for 3 to 20 hours to cause carbon in the alloy to react with the oxide film on the surface of said particles whereby the carbon is removed from said particles, nitrogen being removed by said hydrogen stream.

* * * * *

UNITED STATES PATENT AND TRADEMARK OFFICE

CERTIFICATE OF CORRECTION

PATENT NO. : 4,050,960

DATED : September 27, 1977

INVENTOR(S) : Yasushi Nakamura; Michihisa Itou and Mitsuo Uchimura

It is certified that error appears in the above-identified patent and that said Letters Patent are hereby corrected as shown below:

At Col. 1, line 20, "satifactory extent" should read --satisfactory extent--.

At Col. 1, line 64, "0.5 mm" should read --0.05 mm--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*